United States Patent [19]

O'Rourke

[11] Patent Number: 5,060,438

[45] Date of Patent: Oct. 29, 1991

[54] METHOD AND APPARATUS FOR SUPPORTING A TILE COUNTER CAP SUPPORT STRIP

[76] Inventor: Dennis S. O'Rourke, 630 East Walnut, Orange, Calif. 92667

[21] Appl. No.: 526,037

[22] Filed: May 18, 1990

[51] Int. Cl.[5] ..... E04B 2/00

[52] U.S. Cl. ..... 52/371; 52/287; 52/254; 52/259

[58] Field of Search ..... 52/255, 287, 254, 256, 52/257, 288, 371, 389, 179, 85, 259, 442, 586, 127.3; 312/111, 257 A, 263

[56] References Cited

U.S. PATENT DOCUMENTS 3,426,490 2/1969 Taylor ..... 52/388 X 4,829,731 5/1989 Schluter ..... 52/287

4,858,404 8/1989 Schluter ..... 52/179

*Primary Examiner*—David A. Scherbel

*Assistant Examiner*—Creighton Smith

*Attorney, Agent, or Firm*—Poms, Smith, Lande & Rose

[57] ABSTRACT

A channel shaped cap support strip for a cap strip of a tiled counter top is formed with a plurality of projecting tongues that are embedded within the adhesive that overlies the horizontal surface of the counter, with the body of the cap support strip channel being nailed to the vertical surface of the front of the counter. The tongues, embedded in the adhesive that holds the tile in place, hold the upper part of the cap support strip securely tied to the counter top and prevent flexing and cracking of the tile cap strips.

15 Claims, 1 Drawing Sheet

METHOD AND APPARATUS FOR SUPPORTING A TILE COUNTER CAP SUPPORT STRIP

BACKGROUND OF THE INVENTION

The present invention relates to the tiling of counter or cabinet tops and more particularly concerns support of the tile cap that forms the corner at the front of the counter top.

In a common method of covering counter or cabinet tops with tile, a cap support strip is nailed to the front vertical surface of the counter with the top of the strip extending a selected distance above the counter top. The top of the cap strip is employed to screed or level the upper surface of a coat of adhesive or cement or the like that is laid down upon the counter top, level with the top of the cap strip, for support of tile and tile caps with which the counter is to be covered. The tile caps, which are right angled tile pieces, have a horizontal leg section which forms a forward most extension of the tiles on the horizontal surface of the counter and a vertical leg section that extends a short distance downwardly along the front face of the counter. The cap support strip is interposed between the vertical leg section of the tile cap and the front face of the counter.

Because the top of a cap support strip may extend as much as an inch or more above the top of the counter surface and is connected to the counter only by a lower portion of the cap support, it may tend to flex about a generally horizontal axis extending along the length of the support strip. Therefore, after the tile cap has been set in place and rests upon the top of the support strip, any flexure of the upper portion of the support strip will tend to crack the adhesive and crack the tile cap. This cracking of the tile cap is an all too common occurrence and necessitates time consuming, laborious and costly removal and replacement of broken tile caps.

Accordingly, it is an object of the present invention to support a tile cap in a manner that avoids or minimizes above-mentioned problems.

SUMMARY OF THE INVENTION

In carrying out principles of the present invention in accordance with a preferred embodiment thereof, a tile cap support strip is formed of an elongated member having a planar web section and a plurality of locking elements or tongues mutually spaced along the length of the support strip and projecting away from the web at an upper portion thereof. According to one feature of the invention, each of the tongues is struck out of the web section to effectively from an inside corner between one side of the web section and a lower side of the locking portion. This inside corner is positioned adjacent the outside corner of the counter or cabinet front, with the locking portion extending along and spaced above an upper surface of the counter, so that abed of adhesive laid upon the upper surface of the counter will embed and adhere to the locking portion to hold the upper part of the support strip in place upon the counter corner.

A method according to principles of the present invention embodies the forming of a tile cap support strip with an upstanding portion and a locking portion secured to an upper part of the web portion and projecting laterally away from the web portion. The tile cap support strip is positioned at the corner of a counter or cabinet with the web extending substantially vertically along a vertical surface of the counter or cabinet and the locking portion extending along and spaced above a horizontal surface at the corner of the cabinet or counter. An adhesive material or cement is laid upon at least a portion of the horizontal surface of the counter or cabinet top so as to embed and bond to the locking portion in the material. Then a corner tile cap is mounted upon the tile cap strip support, with a first leg of the tile cap extending along the locking portion and a second leg of the tile cap extending along and spaced from the web portion.

DETAILED DESCRIPTION OF THE INVENTION

Figure 1:
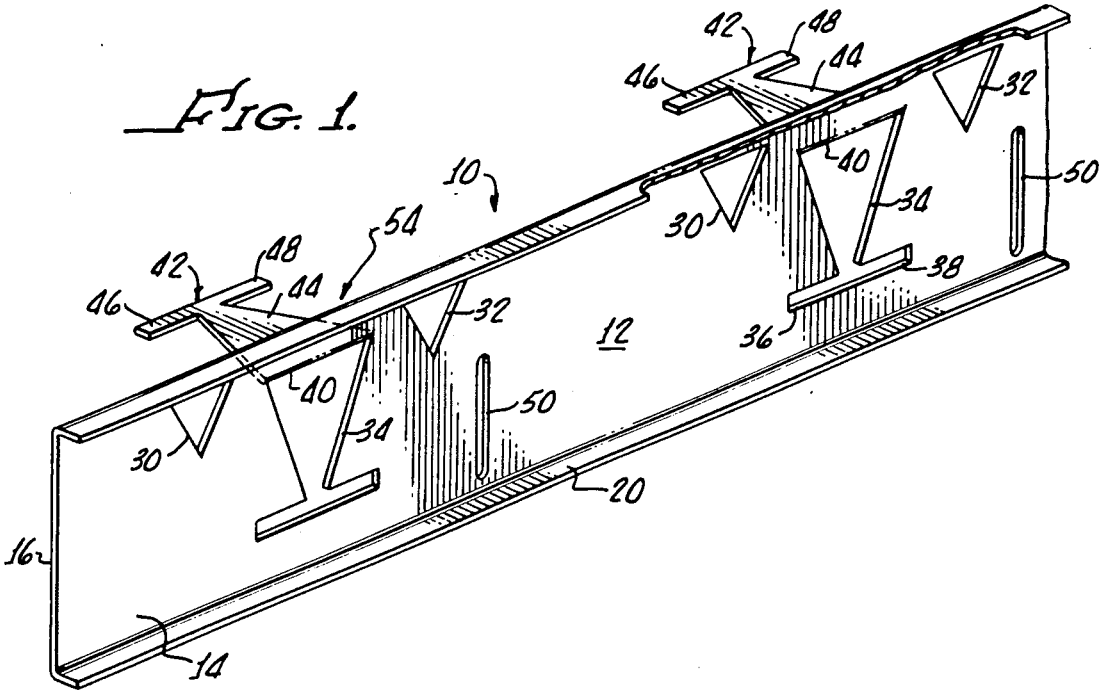
FIG. 1 is a pictorial illustration of a section of a tile cap support strip embodying principles of the present invention.

As illustrated in FIG. 1, a tile cap support strip embodying principles of the present invention includes a generally angulated or channel shaped metallic strip 10 of a length commensurate with the length of the counter to be tiled. The strip is preferably made of a rigid sheet metal and includes a body section or web 12, having an outer surface 14 and an inner surface 16. Integrally formed with the web 12 and bent substantially at right angles to upper and lower ends of the web are upper and lower strip flanges 18, 20, which are coextensive with the length of the web section.

Formed along the length of the cap support strip is a repeating pattern of apertures and tongue. The patterns are identical to one another and spaced from one another at about two inch intervals for a cap support strip having a web height of approximately one and three-quarter inches. Each pattern includes a triangular shaped cutout 30 and a second cutout 32 both flanking (on opposite sides) a larger roughly triangular shaped cutout 34. Material of the cutouts 30, 32 is completely removed and discarded, but material of cutout 34 remains connected to the web at an upper part of the cutout 34. The cutout 34, although of generally triangular shape, includes a pair of oppositely disposed and oppositely extending ears 36, 38. This cutout is basically formed by a partially closed, but not completely closed, cut, so that the material of the web is not severed along a bend line 40, at an upper edge of cutout 34. The material encompassed within the generally triangular shaped cutout 34 is bent along line 40 to extend laterally away from the inner surface of the web to define a projecting locking portion or locking tongue, generally indicated at 42. The tongue, of course, is of the same configuration as the cutout 34, 36, 38 and includes a generally triangular plate portion 44 and first and second locking ears 46, 48 extending laterally from the free end of the plate 44 in general alignment with each other and substantially parallel to the longitudinal extent of the cap support strip.

Located adjacent to but at one side of the group of cutouts 30, 32, 34, and in a lower portion of the web, is an elongated nail receiving slot 50 extending substantially perpendicular to the length of the flanges 18, 20 from a lower end of the slot that is adjacent flange 20 to an upper end of the slot that extends to about the midpoint of the vertical height of the web 12. The pattern of three generally triangular apertures and a nail slot, together with tongue 42, is repeated along the length of the cap support strip so that an adjacent pattern 54 is positioned with its nail slot approximately two inches away from the nearest end of the triangular slot 30 of the adjacent pattern of cutouts. Thus, each pattern includes a locking or connecting element (tongue 42) for the upper portion of the support strip and a corresponding locking or connecting element (nail slot 50) for the lower portion of the support strip to enable both top and bottom parts of the strip to be firmly secured, as will be described below.

It will be understood that the shape of the various cutouts and the groupings and patterns thereof may be varied widely as may be deemed necessary or desirable without departing from principles of the present invention. The triangular apertures or cutouts may be rectangular, circular or have other multi-lateral configurations. So, too, the tongue cutout may vary in its configuration, although at present the described configuration is preferred because it provides an increased area of connection between the plate 44 and the web 12 and further provides the extending ears 46, 48 which, as will be described more particularly below, resist outward bending of the upper portion of the cap support strip when embedded in the adhesive or cement of the counter top.

In the us of the described cap support strip for installation of tile upon a counter top, a layer of a water impervious paper, such as a tar paper 60, is first laid upon the upper surface of the counter top 62, which is connected at its front edge to a counter front structure 64, forming an upper front edge of the counter. The tar paper is secured, as by stapling or the like, to the counter top and then a sheet of metal lath 66 is laid directly upon the tar paper and secured through the paper to the counter top. At this time the cap support strip 10 is positioned with the inner surface of its web 12 against the forward vertical surface 70 of the counter front 64. This support strip is located at a height such that its upper flange 18 is at a level desired for the upper surface of a bed of adhesive, such as cement, mortar or the like that is to be laid down upon the counter top and directly upon the metal lath 66. The vertical elongation of nail slots 50 permit a relatively wide range of vertical adjustment of the cap support strip. The cap strip 10 is leveled to enable its upper flange 18 to provide a desired guide, level and elevation for the upper surface of the bed of adhesive, and nails 72 are driven through the several nail slots to securely fix the cap strip in its selected elevation and position, and to affix the lower portion of the cap strip to the surface 70.

Figure 2:
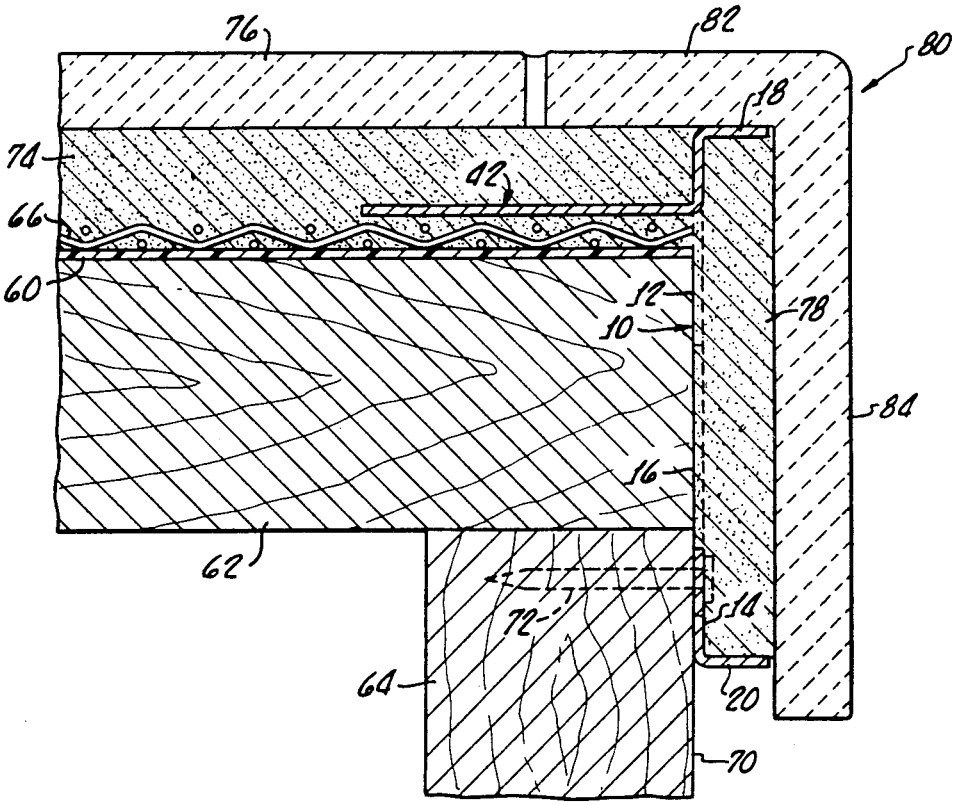
FIG. 2 is a vertical section, showing a completed installation of tiles and tile caps upon a counter top with a tile cap support strip positioned to support the tile cap.

With the cap strip positioned as described above, as much as one half or more of its upper portion may be above the upper surface of counter top 62 (although a smaller portion extends above the counter in the installation illustrated in FIG. 2). The locking portions or tongues 42 still extend away from the web, substantially at right angles thereto, along and at a distance above the upper surface of the counter. Because the locking tongues 42 are located closely adjacent the upper flange 18 of the cap support strip, the tongues are not only above the counter top but also spaced above the paper 60 and the lath 66, leaving a space between the bottom of the locking plate or tongue 42 and the lath for reception of the adhesive material.

Now a bed of adhesive material, generally indicated at 74, is laid down upon the lath 66 to penetrate the lath and bear against the paper. The upper surface of this adhesive is floated or screeded to a level planar surface even with the upper surface of upper flange 18 of the cap support strip. In fact, if a screed bar is employed, the flange 18 may be used as a sliding support for the screed bar as it is moved across the surface of the mortar or cement to level such surface.

As the mortar or cement is applied it is caused to flow around both sides and top and bottom of each locking tongue, which are all firmly and completely embedded in and bonded to the cement. Now the top surface tiles, such as tile 76, are positioned on and bonded to the upper surface of the adhesive. The outer face of the cap support strip 10 is filled with adhesive 78 between its upper and lower flanges 18 and 20, and then the tile cap strips 80 are positioned with their horizontal legs 82 resting directly on the upper surface of upper flange 18 and bonded to the upper surface of the adhesive 74. The vertical legs 84 of the tile cap abut the edges of the cap support strip flanges 18, 20 and bond to the adhesive 78 that is confined within the channel of the cap support strip. The tiles are, of course, grouted in a conventional manner.

Cutouts 30, 32 from which all material is removed, and the cutouts 34 provide a continuity of adhesive mortar or cement from the outer surface 14 to the inner surface 16 of the cap support strip, and thus help to secure the cap strip in place. The operation of such cutouts, however, as previously described, has not been found sufficient to satisfactorily stabilize the upper portion of the cap support strip, so that without the tongues 42 of the present invention frequent cracking of the tile caps occurs.

It will be seen that the embedded locking tongues 42, completely embedded and locked into the rigid, set mortar or cement 74, will fixedly, rigidly and firmly support the upper portion of the cap support strips and prevent any outward bending of such upper portion, such as has been the cause, in past installations, of cracking of the tile caps. Laterally projecting ears 46, 48 of the locking tongues 42 provide additional surface that will resist any outward motion of the upper portion of the cap support strip so that the locking effect does not depend only upon the adhesion of the cement to the upper and lower surfaces of the tongues. The configuration of the tongues, particularly with their lateral projecting ears 46, 48, provides an effective mechanical interlock of the tongues embedded within the mortar or cement 74.

In an exemplary embodiment of the cap support strip the small triangular cutouts 30 and 32 may be in the form of equilateral triangles, having their sides $\frac{5}{8}$ inch long and their uppermost horizontal side located about $\frac{1}{8}$ inch below the upper flange 18. The large triangular cutout portion of the tongue 42 may be also formed of an equilateral triangle having one inch sides, with the combined length of the ears 36, 38 providing a length of about 1 $\frac{1}{8}$ inch, with a thickness of about 1/8 inch for such ears. The upper horizontal side of the cutout triangle which forms the bend line for the tongue 42 may be positioned about $\frac{1}{4}$ inch below the upper flange 18, and the two smaller triangular cutouts maybe spaced about $\frac{1}{4}$ inch away from the corners of the larger cutout 34. Nail slot 50 has a width sufficient to accept a nail of appropriate size and extends from a point about $\frac{1}{8}$ inch above the lower flange 20 to an area at approximately the midpoint of the web section 12. Obviously these dimensions are provided solely as an example and may be readily varied as deemed necessary or desirable. So too various arrangements other than the nail slots 50 may be provided to secure the lower portion of the cap support strip to the counter front member 64, and many different cutout configurations may be employed for the cutouts 30, 32 and the tongues 42, together with their locking ears 46, 48. Moreover, the support strip itself may have other angulated configurations such as, for example, an L-shaped configuration in which one of the flanges 18, 20 is omitted.

The foregoing detailed description is to b clearly understood as given by way of illustration and example only, the spirit and scope of this invention being limited solely by the appended claims.

What is claimed is:

1. In a tile covered structure having substantially horizontal and vertical surfaces meeting to form a structure corner and having a plurality of tiles covering at least part of said horizontal surface, and a plurality of corner tiles each formed of substantially horizontal and vertical leg sections positioned at said corner, said tiles being secured to said structure by adhesive material between the tiles and structure, the improvement comprising:

a corner tile support strip having a body portion extending between said vertical leg section and said vertical surface, and a locking portion extending between said horizontal leg section and said horizontal surface, said locking portion extending horizontally at a distance above said horizontal surface of said structure into adhesive material between said horizontal leg section and said horizontal surface.

2. The invention of claim 1 wherein said body portion has an upper end positioned above said horizontal surface and wherein said locking portion projects away from said body portion below said upper end.

3. In a tile covered structure having substantially horizontal and vertical surfaces meeting to form a structure corner and having a plurality of tiles covering at least part of said horizontal surface, and a plurality of corner tiles each formed of substantially horizontal and vertical leg sections positioned at said corner, said tiles being secured to said structure by adhesive material between the tiles and structure, the improvement comprising:

a corner tile support strip having a body portion extending between said vertical leg section and said vertical surface, and a locking portion extending between said horizontal leg section and said horizontal surface, said body portion comprising a channel shaped member having upper and lower flanges and a web extending between and integral with said flanges, said locking portion comprising a tongue struck from said web and bent along a line below said upper flange to extend along said horizontal surface.

4. The invention of claim 3 wherein said line is positioned close to said upper flange whereby said tongue projects from the web just below said upper flange, and including a plurality of fastening means formed in a lower portion of said web for connecting said lower portion to said vertical surface.

5. The invention of claim 3 wherein part of said adhesive material is positioned between said horizontal surface and said horizontal leg section, and wherein said tongue is embedded within said part of said adhesive.

6. The invention of claim 3 wherein said tongue includes a plate section connected at one end thereof to said web and having a free end, and a plurality of laterally extending ears fixed to said free end of said plate section.

7. In a tile covered structure having substantially horizontal and vertical surfaces meeting to form a structure corner and having a plurality of tiles covering at least part of said horizontal surface, and a plurality of corner tiles each formed of substantially horizontal and vertical leg sections positioned at said corner, said tiles being secured to said structure by adhesive material between the tiles and structure, the improvement comprising:

a corner tile support strip having a body portion extending between said vertical leg section and said vertical surface, and a locking portion extending between said horizontal leg section and said horizontal surface, said body portion comprising a substantially planar web, said locking portion comprising a tongue struck from said web and projecting away from the web along and above said horizontal surface, said tongue being embedded in the adhesive material between said horizontal surface and said horizontal leg section.

8. A method of supporting a tile cap upon the corner of a counter, cabinet or the like which has an upper surface thereof to be covered with tiles, including a row of tile caps along the corner, said tile caps having first and second legs, said method comprising the steps of:

forming a tile cap support strip having an upstanding web portion and a locking portion secured to an upper part of the web portion and projecting laterally away from the web portion, positioning said tile cap support strip at the corner of said counter or cabinet with said web extending substantially vertically along a vertical surface of the counter or cabinet and said locking portion extending along and spaced above a horizontal surface at the corner of said cabinet or counter, laying an adhesive material upon at least a portion of said horizontal surface of the counter top and embedding said locking portion in such material, and mounting a corner tile cap upon said tile cap support strip with a first leg of the tile cap extending along and spaced from said locking portion and a second leg of said tile cap extending along and spaced from said web portion.

9. The method of claim 8 wherein said step of providing a locking portion on said web portion comprises the step of forming a partially closed cut through said support strip web and bending out from said web the material of the web within said partially closed cut to form said locking portion.

10. The method of claim 9 including the step of forming on said locking portion a pair of ears extending laterally, substantially in the plane of said locking portion.

11. A tile cap support strip comprising:

an elongated angulated member having a substantially planar body section, and a plurality of locking portions mutually spaced along the length of said support strip, each said locking portion being struck out from said body section to form an inside corner between one side of said body section and a lower side of said locking portion, said strip being configured to be positioned on the edge of a counter, cabinet or the like having an outside corner adjacent said inside corner with said locking portion extending along and spaced above an upper surface of said counter or cabinet, and said body section extending along a vertical front surface of said cabinet or counter and projecting above said upper surface, whereby a bed of adhesive laid upon the upper surface of the counter or cabinet will embed and adhere to said locking portion to hold said support strip in place upon said counter corner, and whereby a tile cap positioned on an upper end of said body section will be firmly supported on the counter or cabinet.

12. The cap tile support strip of claim 11 wherein said locking portion comprises a plate struck from and bent out of the body section of said support strip along a line that is close to but slightly below said upper end, whereby when said plate is positioned on a counter top said upper end extends above said counter top.

13. The cap support strip of claim 12 where in said plate has at least one lateral projection lying in the plane of said plate.

14. A tile covered structure comprising:

a counter including a horizontal surface and a vertical surface joining the horizontal surface to define a counter corner, a tile cap support strip extending along said vertical surface at said corner, having a lower portion below said horizontal surface, and having an upper portion projecting above said horizontal surface, a layer of adhesive on said horizontal surface, a plurality of surface tiles bonded to said adhesive, a plurality of tile caps bonded to said adhesive and overlying said tile cap support strip, and means for securing both said lower and upper portions of said support strip to said counter.

15. The structure of claim 14 wherein said means for securing comprises a locking tongue fixed to said upper portion and embedded within said adhesive.

* * * * *